US009611843B2

(12) United States Patent
Hsueh et al.

(10) Patent No.: US 9,611,843 B2
(45) Date of Patent: Apr. 4, 2017

(54) MICRO-GAS PRESSURE DRIVING APPARATUS

(71) Applicant: MICROJET TECHNOLOGY CO., LTD., Hsinchu (TW)

(72) Inventors: Ta-Wei Hsueh, Hsinchu (TW); Ying-Lun Chang, Hsinchu (TW); Hsiang-Dyi Wu, Hsinchu (TW); Rong-Ho Yu, Hsinchu (TW); Shih-Chang Chen, Hsinchu (TW); Tsung-Pat Chou, Hsinchu (TW); Yau-Ji Lee, Hsinchu (TW); Jia-Yu Liao, Hsinchu (TW)

(73) Assignee: MICROJET TECHNOLOGY CO., LTD., Hsinchu (TW)

( * ) Notice: Subject to any disclaimer, the term of this patent is extended or adjusted under 35 U.S.C. 154(b) by 433 days.

(21) Appl. No.: 14/272,272

(22) Filed: May 7, 2014

(65) Prior Publication Data

US 2014/0377099 A1 Dec. 25, 2014

(30) Foreign Application Priority Data

Jun. 24, 2013 (TW) ..... 102122446 A

(51) Int. Cl.
*F04B 43/04* (2006.01)
*F04B 49/22* (2006.01)

(52) U.S. Cl.
CPC ..... *F04B 43/046* (2013.01); *F04B 49/22* (2013.01)

(58) Field of Classification Search
CPC .. F04B 17/003; F04B 39/1073; F04B 39/108; F04B 39/1086; F04B 43/0045;
(Continued)

(56) References Cited

U.S. PATENT DOCUMENTS 2,928,409 A * 3/1960 Johnson ..... G05D 16/2093 137/82
4,514,742 A * 4/1985 Suga ..... B41J 2/17596 137/513.7

(Continued)

FOREIGN PATENT DOCUMENTS

| | | |
|---|---|---|
| CN | 101986787 | 3/2011 |
| JP | 2013200131 | 10/2013 |
| TW | 201204941 | 2/2012 |

*Primary Examiner* — Devon Kramer
*Assistant Examiner* — Joseph Herrmann
(74) *Attorney, Agent, or Firm* — Kirton McConkie; Evan R. Witt

(57) ABSTRACT

A micro-gas pressure driving apparatus includes a miniature gas transportation module and a miniature valve module. The miniature gas transportation module includes a gas inlet plate, a fluid channel plate, a resonance membrane and a piezoelectric actuator. A first chamber is defined between the resonance membrane and the piezoelectric actuator. After the piezoelectric actuator is activated to feed a gas through the gas inlet plate, the gas is transferred to the first chamber through the fluid channel plate and the resonance membrane and then transferred downwardly. Consequently, a pressure gradient is generated to continuously push the gas. The miniature valve module includes a gas collecting plate, a valve membrane and a gas outlet plate. After the gas is transferred from the miniature gas transportation module to the gas-collecting chamber, the gas is transferred in one direction, so that a pressure-collecting operation or a pressure-releasing operation is selectively performed.

13 Claims, 11 Drawing Sheets

(58) Field of Classification Search
CPC ..... F04B 43/023; F04B 43/046; F04B 49/08; F04B 49/22; F16K 99/0048
USPC ..... 251/129.06
See application file for complete search history.

(56) References Cited

U.S. PATENT DOCUMENTS

| | | | | | |
|---|---|---|---|---|---|
| 6,033,191 | A * | 3/2000 | Kamper | F04B 43/043 | 417/322 |
| 6,318,641 | B1 * | 11/2001 | Knebel | F02M 51/06 | 137/338 |
| 6,830,229 | B2 * | 12/2004 | Wetzel | F15C 5/00 | 137/596.16 |
| 7,565,744 | B2 * | 7/2009 | Matsui | F04B 43/043 | 137/512 |
| 7,972,124 | B2 * | 7/2011 | Hirata | F04B 39/1093 | 417/413.2 |
| 8,157,549 | B2 * | 4/2012 | Chen | B41J 2/17596 | 417/571 |
| 8,308,453 | B2 * | 11/2012 | Yamamoto | F04B 43/028 | 417/413.2 |
| 2008/0170951 | A1 * | 7/2008 | Satoh | F04B 43/04 | 417/413.2 |
| 2009/0243431 | A1 * | 10/2009 | Ohsawa | F04B 43/046 | 310/317 |
| 2011/0079299 | A1 * | 4/2011 | Yuguchi | F16K 15/144 | 137/511 |
| 2013/0058818 | A1 * | 3/2013 | Hirata | F04B 45/047 | 417/479 |
| 2013/0249022 | A1 | 9/2013 | Du et al. | | |

* cited by examiner

MICRO-GAS PRESSURE DRIVING APPARATUS

FIELD OF THE INVENTION

The present invention relates to a pneumatic apparatus, and more particularly to a slim and silent micro-gas pressure driving apparatus.

BACKGROUND OF THE INVENTION

With the advancement of science and technology, fluid transportation devices used in many sectors such as pharmaceutical industries, computer techniques, printing industries or energy industries are developed toward elaboration and miniaturization. The fluid transportation devices are important components that are used in for example micro pumps, micro atomizers, print heads or industrial printers for transporting small amounts of gases or liquids. Therefore, it is important to provide an improved structure of the fluid transportation devices.

For example, in the pharmaceutical industries, pneumatic apparatus or pneumatic machines use motors or pressure valves to transfer gases. However, due to the volume limitations of the motors and the pressure valves, the pneumatic apparatus or the pneumatic machines are bulky in volume. In other words, the conventional pneumatic apparatus fails to meet the miniaturization requirement and is not portable. Moreover, during operations of the motor or the pressure valve, annoying noise is readily generated. That is, the conventional pneumatic apparatus is neither friendly nor comfortable to the user.

Therefore, there is a need of providing a micro-gas pressure driving apparatus with small, miniature, silent, portable and comfortable benefits in order to eliminate the above drawbacks.

SUMMARY OF THE INVENTION

The present invention provides a micro-gas pressure driving apparatus for a portable or wearable equipment or machine. The micro-gas pressure driving apparatus integrates the functions of a miniature gas transportation module and a miniature valve module. Consequently, the micro-gas pressure driving apparatus is small, miniature, silent, portable and comfortable.

In accordance with an aspect of the present invention, there is provided a micro-gas pressure driving apparatus. The micro-gas pressure driving apparatus includes a miniature gas transportation module and a miniature valve module. The miniature gas transportation module includes a gas inlet plate, a fluid channel plate, a resonance membrane, and a piezoelectric actuator. The gas inlet plate has at least one inlet. A gas is fed into the miniature gas transportation module through the at least one inlet. The fluid channel plate includes at least one convergence channel and a central opening. The at least one convergence channel is aligned with the at least one inlet of the gas inlet plate. After the gas is fed into the at least one inlet, the gas is guided by the at least one convergence channel and converged to the central opening. The resonance membrane has a central aperture corresponding to the central opening of the fluid channel plate. The piezoelectric actuator includes a suspension plate, an outer frame and a piezoelectric ceramic plate. The suspension plate and the outer frame are connected with each other through at least one bracket. The piezoelectric ceramic plate is attached on a surface of the suspension plate. The gas inlet plate, the fluid channel plate, the resonance membrane and the piezoelectric actuator are stacked on each other sequentially, and the resonance membrane and the piezoelectric actuator are separated from each other by a gap, so that a first chamber is defined between the resonance membrane and the piezoelectric actuator. When the piezoelectric actuator is activated to feed the gas into the miniature gas transportation module through the at least one inlet, the gas is sequentially converged to the central opening through the at least one convergence channel of the fluid channel plate, transferred through the central aperture of the resonance membrane, introduced into the first chamber, transferred downwardly through a vacant space between the bracket, the suspension plate and the outer frame, and exited from the miniature gas transportation module. The miniature valve module includes a gas collecting plate, a valve membrane, and a gas outlet plate. The gas collecting plate includes a first perforation, a second perforation, a first pressure-releasing chamber and a first outlet chamber. The first perforation is in communication with the first pressure-releasing chamber. The second perforation is in communication with the first outlet chamber. The valve membrane has a valve opening. The gas outlet plate includes a third perforation corresponding to the first perforation of the gas collecting plate, a fourth perforation corresponding to the second perforation of the gas collecting plate, a second pressure-releasing chamber, a second outlet chamber and a communication channel. The third perforation is in communication with the second pressure-releasing chamber. The fourth perforation is in communication with the second outlet chamber. The communication channel is arranged between the second pressure-releasing chamber and the second outlet chamber. The gas collecting plate, the valve membrane and the gas outlet plate are stacked on each other sequentially. The valve membrane is arranged between the gas collecting plate and the gas outlet plate. The valve opening of the valve membrane is arranged between the second perforation and the fourth perforation. After the gas is downwardly transferred from the miniature gas transportation module to the miniature valve module, the gas is introduced into the first pressure-releasing chamber and the first outlet chamber through the first perforation and the second perforation, and the gas within the first outlet chamber is further transferred to the fourth perforation through the valve opening of the valve membrane, so that a pressure of the gas is collected. If the collected pressure of the gas is higher than an ambient pressure and a pressure-releasing operation is performed, the gas is transferred from the fourth perforation to the second outlet chamber to move the valve membrane, the valve opening of the valve membrane is contacted with and closed by the gas collecting plate, the gas is transferred from the second outlet chamber to the second pressure-releasing chamber through the communication channel, and the gas is exited from the third perforation.

In accordance with another aspect of the present invention, there is provided a micro-gas pressure driving apparatus. The micro-gas pressure driving apparatus includes a miniature gas transportation module and a miniature valve module. The miniature gas transportation module includes a gas inlet plate, a fluid channel plate, a resonance membrane and a piezoelectric actuator. The gas inlet plate, the fluid channel plate, the resonance membrane and the piezoelectric actuator are stacked on each other sequentially, and the resonance membrane and the piezoelectric actuator are separated from each other by a gap, so that a first chamber is defined between the resonance membrane and the piezoelectric actuator. When the piezoelectric actuator is activated to feed the gas into the miniature gas transportation module, the gas is transferred to the first chamber through the fluid channel plate and the resonance membrane and then transferred downwardly. The miniature valve module includes a gas collecting plate, a valve membrane and a gas outlet plate. The gas collecting plate includes at least two perforations and at least two chambers. The valve membrane has a valve opening. The gas outlet plate includes at least two perforations and at least two chambers. The gas collecting plate, the valve membrane and the gas outlet plate are stacked on each other sequentially. A gas-collecting chamber is formed between the miniature gas transportation module and the miniature valve module. After the gas is downwardly transferred from the miniature gas transportation module to the gas-collecting chamber, the gas is introduced into the miniature valve module. While the gas is transferred through the at least two perforations and the at least two chambers of the gas collecting plate and the at least two perforations and the at least two chambers of the gas outlet plate in one direction, the valve opening of the valve membrane is correspondingly opened or closed, so that a pressure-collecting operation or a pressure-releasing operation is performed.

In accordance with a further aspect of the present invention, there is provided a micro-gas pressure driving apparatus. The micro-gas pressure driving apparatus includes a miniature gas transportation module and a miniature valve module. The miniature gas transportation module includes a gas inlet plate, a fluid channel plate, a resonance membrane and a piezoelectric actuator. The gas inlet plate, the fluid channel plate, the resonance membrane and the piezoelectric actuator are stacked on each other sequentially, and the resonance membrane and the piezoelectric actuator are separated from each other by a gap, so that a first chamber is defined between the resonance membrane and the piezoelectric actuator. When the piezoelectric actuator is activated to feed the gas into the miniature gas transportation module, the gas is transferred to the first chamber through the fluid channel plate and the resonance membrane and further transferred. The miniature valve module includes a gas collecting plate, a valve membrane and a gas outlet plate. The gas collecting plate, the valve membrane and the gas outlet plate are stacked on each other sequentially. The valve membrane has a valve opening. After the gas is downwardly transferred from the miniature gas transportation module to the gas-collecting chamber, a pressure-collecting operation or a pressure-releasing operation is selectively performed.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

The present invention provides a micro-gas pressure driving apparatus. The micro-gas pressure driving apparatus may be used in many sectors such as pharmaceutical industries, energy industries, computer techniques or printing industries for transporting gases.

Figure 1:
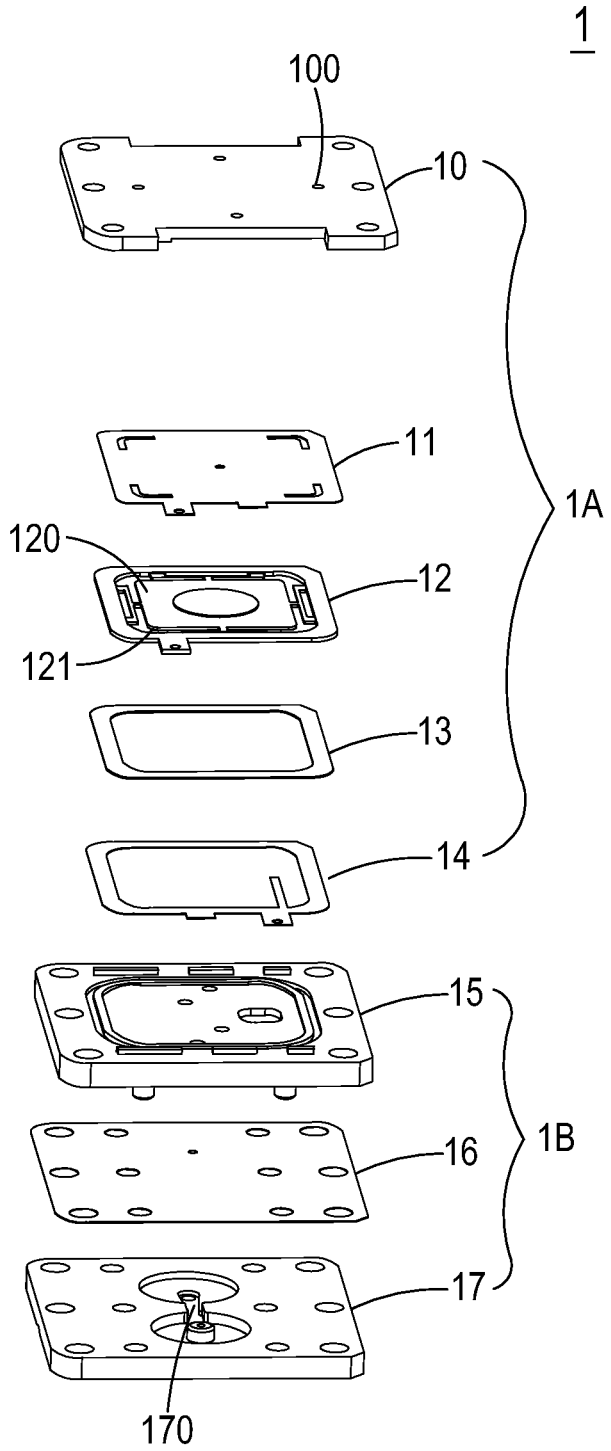
FIG. 1 is a schematic exploded view illustrating a micro-gas pressure driving apparatus according to a first embodiment of the present invention and taken along a front side.

FIG. 1 is a schematic exploded view illustrating a micro-gas pressure driving apparatus according to a first embodiment of the present invention and taken along a front side. As shown in FIG. 1, the micro-gas pressure driving apparatus 1 comprises a miniature gas transportation module 1A and a miniature valve module 1B. In this embodiment, the miniature gas transportation module 1A at least comprises a gas inlet plate 10, a resonance membrane 11, a piezoelectric actuator 12, an insulating plate 13, and a conducting plate 14. The piezoelectric actuator 12 is aligned with the resonance membrane 11. The gas inlet plate 10, the resonance membrane 11, the piezoelectric actuator 12, the insulating plate 13 and the conducting plate 14 are stacked on each other sequentially. Moreover, the piezoelectric actuator 12 comprises a suspension plate 120 and a piezoelectric ceramic plate 121. In this embodiment, the miniature valve module 1B comprises a gas collecting plate 15, a valve membrane 16, and a gas outlet plate 17. After the miniature gas transportation module 1A and the miniature valve module 1B are combined together, the micro-gas pressure driving apparatus 1 is assembled. Consequently, a gas may be automatically fed into the miniature gas transportation module 1A through at least one inlet 100 of the gas inlet plate 10. In response to the actions of the piezoelectric actuator 12, the gas is transferred downwardly through plural pressure chambers (not shown). Then, the gas is transferred through the miniature valve module 1B in one direction. The pressure of the gas is accumulated in a container (not shown) that is in communication with an outlet of the miniature valve module 1B. For releasing the pressure, the output gas amount of the miniature gas transportation module 1A is exited from a communication channel 170 of the gas outlet plate 17 of the miniature valve module 1B.

Figure 2A:
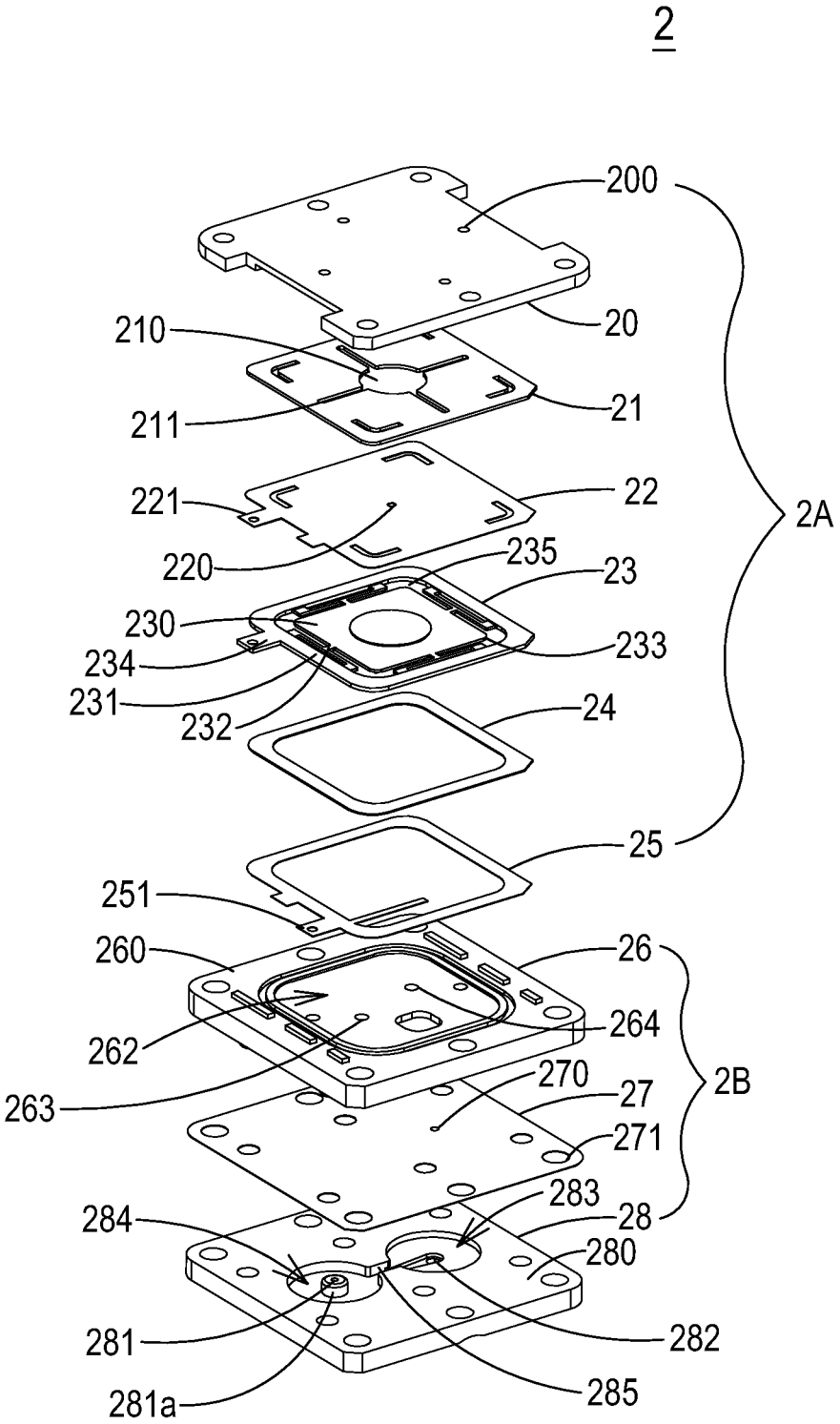
FIG. 2A is a schematic exploded view illustrating a micro-gas pressure driving apparatus according to a second embodiment of the present invention and taken along a front side.
Figure 2B:
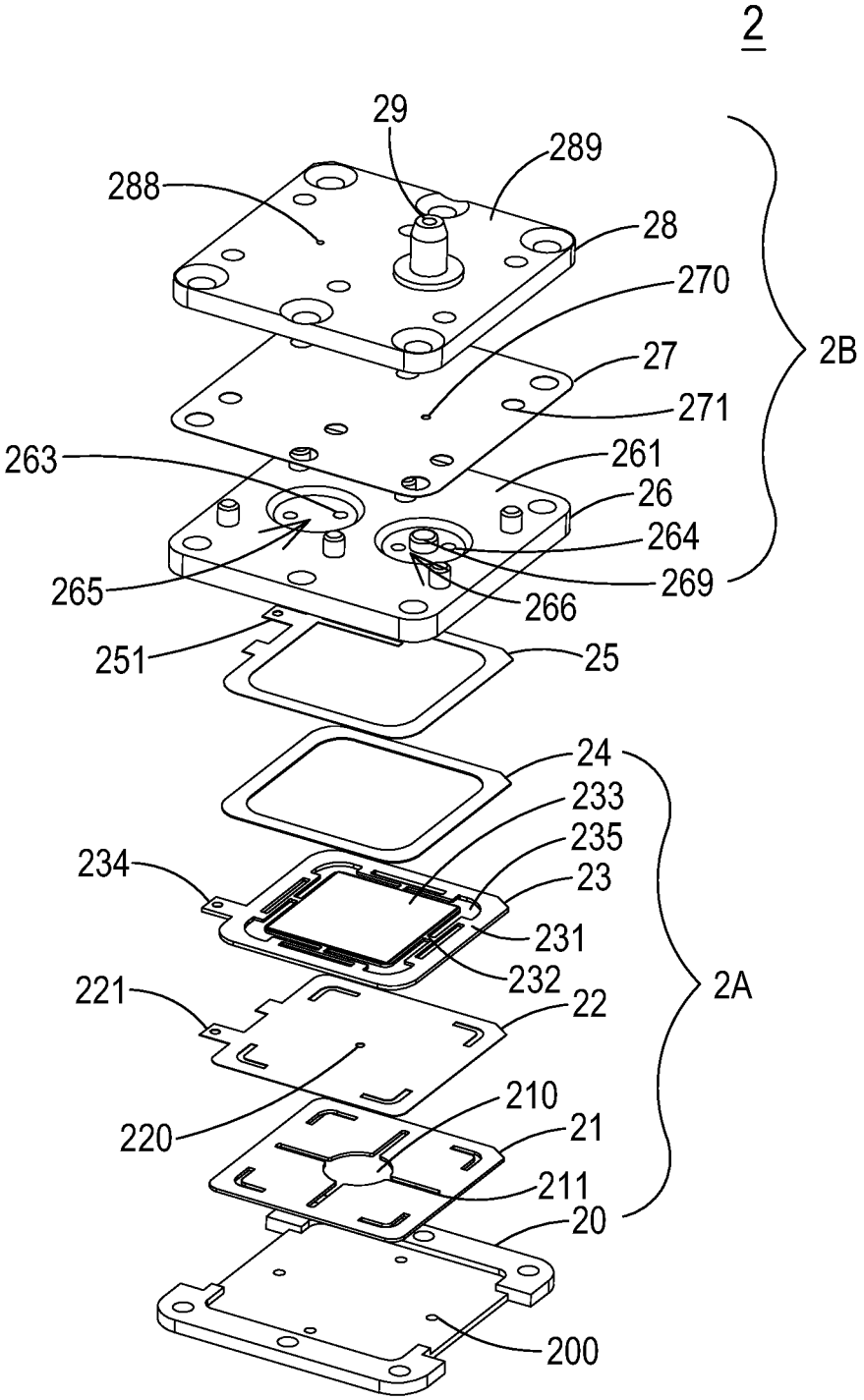
FIG. 2B is a schematic exploded view illustrating the micro-gas pressure driving apparatus according to the second embodiment of the present invention and taken along a rear side.

FIG. 2A is a schematic exploded view illustrating a micro-gas pressure driving apparatus according to a second embodiment of the present invention and taken along a front side. FIG. 2B is a schematic exploded view illustrating the micro-gas pressure driving apparatus according to the second embodiment of the present invention and taken along a rear side. As shown in FIGS. 2A and 2B, the micro-gas pressure driving apparatus 2 comprises a miniature gas transportation module 2A and a miniature valve module 2B. In this embodiment, the miniature gas transportation module 2A at least comprises a gas inlet plate 20, a fluid channel plate 21, a resonance membrane 22, a piezoelectric actuator 23, an insulating plate 24, and a conducting plate 25 are stacked on each other sequentially. In this embodiment, there is a gap g0 between the resonance membrane 22 and the piezoelectric actuator 23 (see FIG. 5A). Alternatively, in some other embodiments, there is no gap between the resonance membrane 22 and the piezoelectric actuator 23. In another embodiment similar to the micro-gas pressure driving apparatus 1 of the first embodiment, the fluid channel plate 21 is integrally formed with the gas inlet plate 20. In this embodiment, the gas inlet plate 20 and the fluid channel plate 21 are separate components. Similarly, the miniature valve module 2B comprises a gas collecting plate 26, a valve membrane 27, and a gas outlet plate 28. The gas collecting plate 26, the valve membrane 27 and the gas outlet plate 28 are stacked on each other sequentially.

In this embodiment, the gas inlet plate 20 of the miniature gas transportation module 2A pneumatic apparatus comprises at least one inlet 200. In response to the action of the atmospheric pressure, a gas may be automatically fed into the miniature gas transportation module 2A through the at least one inlet 200 of the gas inlet plate 20. The fluid channel plate 21 comprises at least one convergence channel 211 corresponding to the at least one inlet 200 of the gas inlet plate 20. After the gas is fed into the at least one inlet 200, the gas is guided by the at least one convergence channel 211 and converged to a central opening 210. Consequently, the gas is transferred downwardly. The resonance membrane 22 is made of a flexible material, but is not limited thereto. Moreover, the resonance membrane 22 has a central aperture 220 corresponding to the central opening 210 of the fluid channel plate 21. Consequently, the gas may be transferred downwardly through the central aperture 220.

Figure 3A:
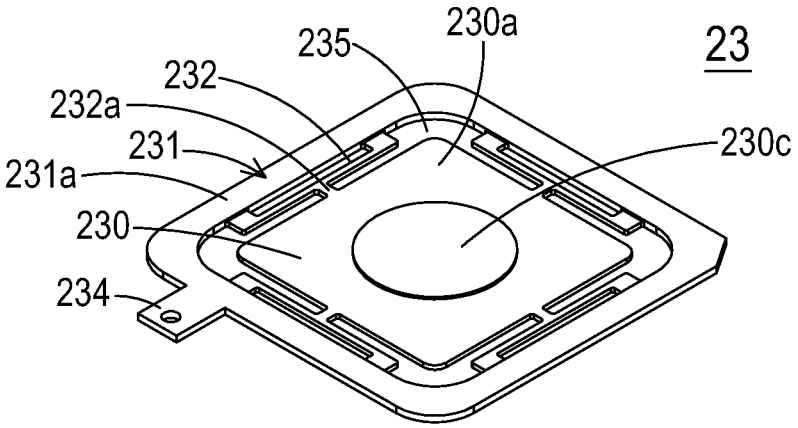
FIG. 3A is a schematic perspective view illustrating the piezoelectric actuator of the micro-gas pressure driving apparatus of FIG. 2A and taken along the front side.
Figure 3B:
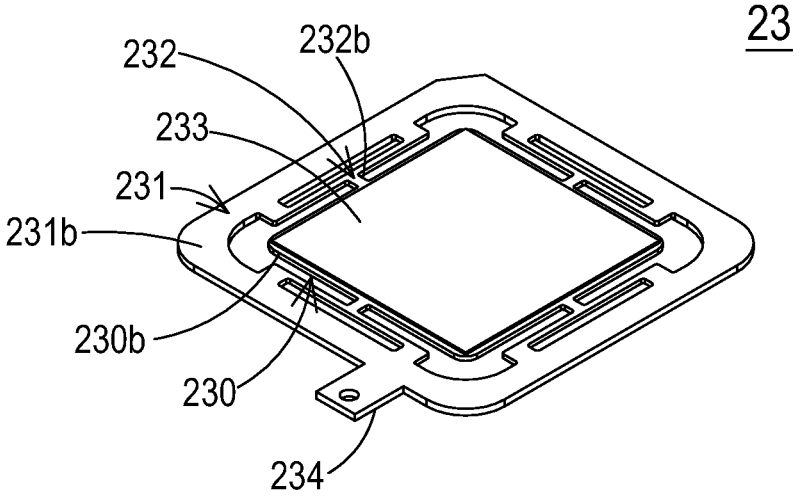
FIG. 3B is a schematic perspective view illustrating the piezoelectric actuator of FIG. 2A and taken along the rear side.
Figure 3C:
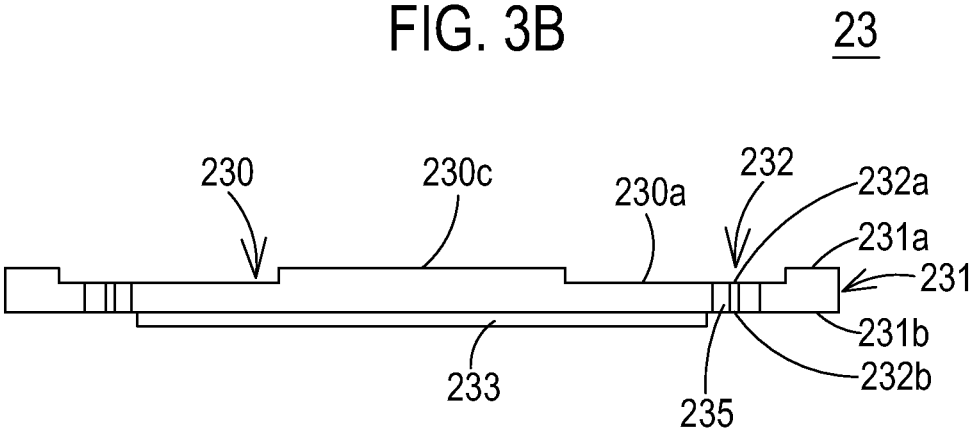
FIG. 3C is a schematic cross-sectional view illustrating the piezoelectric actuator of the micro-gas pressure driving apparatus of FIG. 2A.

FIG. 3A is a schematic perspective view illustrating the piezoelectric actuator of the micro-gas pressure driving apparatus of FIG. 2A and taken along the front side. FIG. 3B is a schematic perspective view illustrating the piezoelectric actuator of FIG. 2A and taken along the rear side. FIG. 3C is a schematic cross-sectional view illustrating the piezoelectric actuator of the micro-gas pressure driving apparatus of FIG. 2A. As shown in FIGS. 3A, 3B and 3C, the piezoelectric actuator 23 comprises a suspension plate 230, an outer frame 231, at least one bracket 232, and a piezoelectric ceramic plate 233. The piezoelectric ceramic plate 233 is attached on a bottom surface 230*b* of the suspension plate 230. The at least one bracket 232 is connected between the suspension plate 230 and the outer frame 231. Moreover, at least one vacant space is formed between the bracket 232, the suspension plate 230 and the outer frame 231 for allowing the gas to go through. The type of the outer frame 231 and the type and the number of the at least one bracket 232 and the piezoelectric ceramic plate 233 may be varied according to the practical requirements. Moreover, a conducting pin 234 is protruded outwardly from the outer frame 231 so as to be electrically connected.

In this embodiment, the suspension plate 230 is a stepped structure. That is, the suspension plate 230 comprises a lower portion 230*a* and an upper portion 230*c*. As shown in FIGS. 3A and 3C, a top surface of the upper portion 230*c* of the suspension plate 230 is coplanar with a top surface 231*a* of the outer frame 231, and a top surface of the lower portion 230*a* of the suspension plate 230 is coplanar with a top surface 232*a* of the bracket 232. Moreover, the upper portion 230*c* of the suspension plate 230 (or the top surface 231*a* of the outer frame 231) has a specified height with respect to the lower portion 230*a* of the suspension plate 230 (or the top surface 232*a* of the bracket 232). As shown in FIGS. 3B and 3C, a bottom surface 230*b* of the suspension plate 230, a bottom surface 231*b* of the outer frame 231 and a bottom surface 232*b* of the bracket 232 are coplanar with each other. The piezoelectric ceramic plate 233 is attached on the bottom surface 230*b* of the suspension plate 230. In some embodiments, the suspension plate 230, the bracket 232 and the outer frame 231 are produced by a metal plate. In other words, after the piezoelectric ceramic plate 233 is attached on the metal plate, the piezoelectric actuator 23 is produced.

Figure 4:
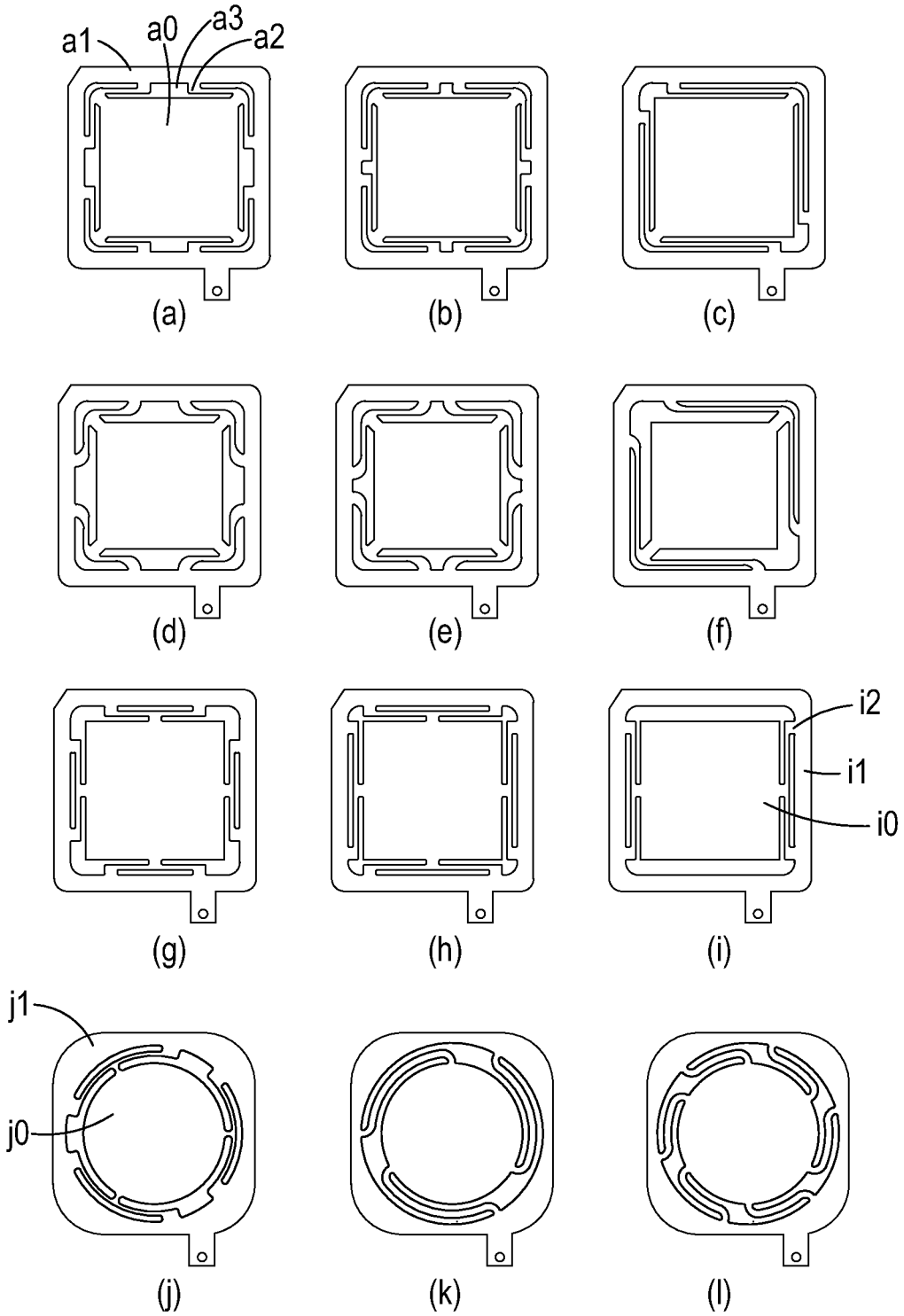
FIG. 4 schematically illustrates various exemplary piezoelectric actuator used in the micro-gas pressure driving apparatus of FIG. 3A.

FIG. 4 schematically illustrates various exemplary piezoelectric actuator used in the micro-gas pressure driving apparatus of FIG. 3A. The suspension plate 230, the outer frame 231 and the at least one bracket 232 of the piezoelectric actuator 23 may have various types. In the type (a), the outer frame a1 and the suspension plate a0 are rectangular, the outer frame a1 and the suspension plate a0 are connected with each other through eight brackets a2, and a vacant space a3 is formed between the brackets a2, the suspension plate a0 and the outer frame a1 for allowing the gas to go through. In the type (i), the outer frame i1 and the suspension plate i0 are also rectangular, but the outer frame it and the suspension plate i0 are connected with each other through two brackets i2. In addition, the outer frame and the suspension plate in each of the types (b)~(h) are also rectangular. In each of the types (j)~(l), the suspension plate is circular, and the outer frame has a rectangular with arc-shaped corners. For example, in the type (j), the suspension plate is circular j0, and the outer frame j1 has a rectangular with arc-shaped corners. It is noted that numerous modifications and alterations of the piezoelectric actuator may be made while retaining the teachings of the invention. For example, the suspension plate 230 may be rectangular or circular, and the piezoelectric ceramic plate 233 attached on the bottom surface 230*b* of the suspension plate 230 may be rectangular or circular. Moreover, the number of the brackets between the outer frame and the suspension plate may be varied according to the practical requirements. Moreover, the suspension plate 230, the outer frame 231 and the at least one bracket 232 are integrally formed with each other and produced by a conventional machining process, a photolithography and etching process, a laser machining process, an electroforming process, an electric discharge machining process and so on.

Please refer to FIGS. 2A and 2B again. The insulating plate 24 and the conducting plate 25 of the miniature gas transportation module 2A are disposed under the piezoelectric actuator 23. The profiles of the insulating plate 24 and the conducting plate 25 substantially match the profile of the piezoelectric actuator 23. The insulating plate 24 is made of an insulating material (e.g. a plastic material) for providing insulating efficacy. The conducting plate 25 is made of an electrically conductive material (e.g. a metallic material) for providing electrically conducting efficacy. Moreover, a conducting pin 221 is protruded outwardly from the resonance membrane 22 corresponding to the conducting pin 234 of the outer frame 231. Moreover, the conducting plate 25 has a conducting pin 251 so as to be electrically connected.

Figure 5A:
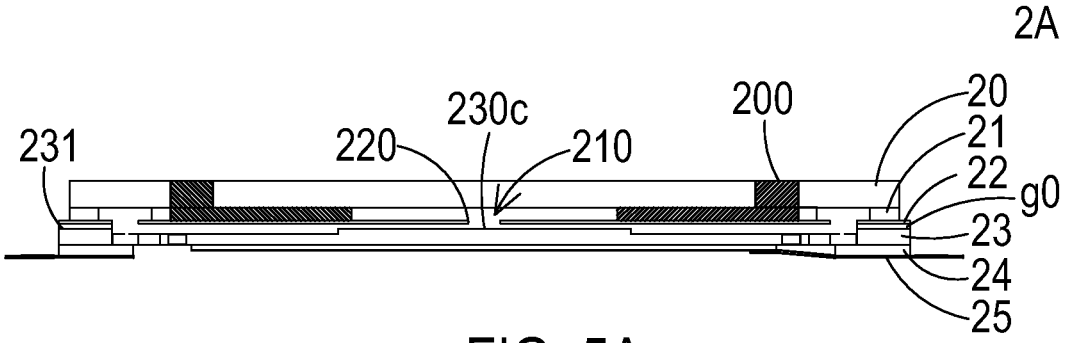
FIGS. 5A-5E schematically illustrate the actions of the miniature gas transportation module of the micro-gas pressure driving apparatus of FIG. 2A.

FIGS. 5A-5E schematically illustrate the actions of the miniature gas transportation module of the micro-gas pressure driving apparatus of FIG. 2A. As shown in FIG. 5A, the gas inlet plate 20, the fluid channel plate 21, the resonance membrane 22, the piezoelectric actuator 23, the insulating plate 24 and the conducting plate 25 of the miniature gas transportation module 2A are stacked on each other sequentially. Moreover, there is a gap g0 between the resonance membrane 22 and the piezoelectric actuator 23. In this embodiment, a filler (e.g. a conductive adhesive) is inserted into the g0 between the resonance membrane 22 and the piezoelectric actuator 23. In other words, the distance between the resonance membrane 22 and the upper portion 230*c* of the suspension plate 230 of the piezoelectric actuator 23 is substantially equal to the height of the gap g0 in order to guide the gas to flow more quickly. Moreover, due to the distance between the resonance membrane 22 and the upper portion 230*c* of the suspension plate 230, the interference between the resonance membrane 22 and the piezoelectric actuator 23 is reduced and the generated noise is largely reduced. In some embodiments, the height of the outer frame 231 of the piezoelectric actuator 23 is increased, so that the gap is formed between the resonance membrane 22 and the piezoelectric actuator 23. In some embodiments, there is no gap between the resonance membrane 22 and the piezoelectric actuator 23.

Please refer to FIGS. 5A-5E again. After the gas inlet plate 20, the fluid channel plate 21, the resonance membrane 22 and the piezoelectric actuator 23 are combined together, a chamber for converging the gas is defined by the central opening 210 of the fluid channel plate 21, the gas inlet plate 20 and the resonance membrane 22 collaboratively, and a first chamber 222 is formed between the resonance membrane 22 and the piezoelectric actuator 23 for temporarily storing the gas. The first chamber 222 is in communication with the chamber that is defined by the central opening 210 of the fluid channel plate 21, the gas inlet plate 20 and the resonance membrane 22. The peripheral regions of the first chamber 222 are in communication with the miniature valve module 2B through the vacant space 235 of the piezoelectric actuator 23.

Figure 5B:
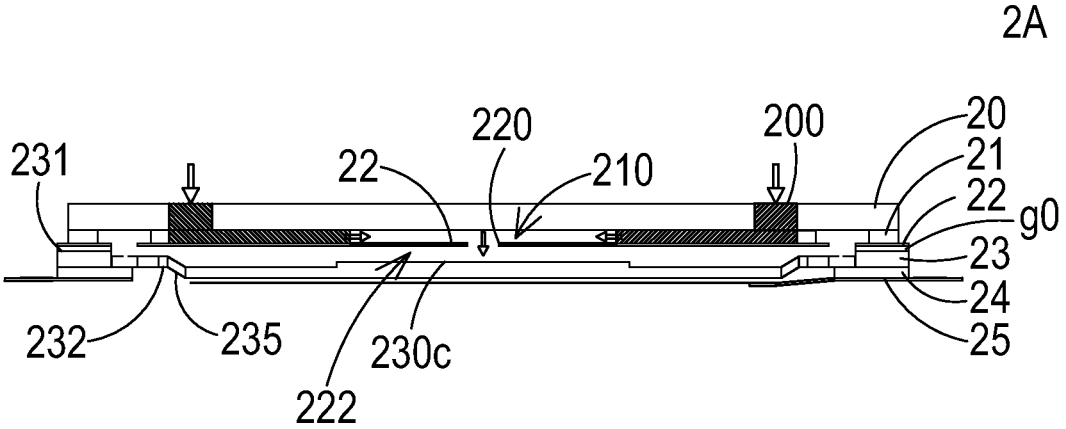

When the miniature gas transportation module 2A of the micro-gas pressure driving apparatus 2 is enabled, the piezoelectric actuator 23 is actuated by an applied voltage. Consequently, the piezoelectric actuator 23 is vibrated along a vertical direction in a reciprocating manner by using the bracket 232 as a fulcrum. As shown in FIG. 5B, the piezoelectric actuator 23 is vibrated downwardly in response to the applied voltage. Consequently, the gas is fed into the at least one inlet 200 of the gas inlet plate 20. The gas is sequentially converged to the central opening 210 through the at least one convergence channel 211 of the fluid channel plate 21, transferred through the central aperture 220 of the resonance membrane 22, and introduced downwardly into the first chamber 222.

Figure 5C:
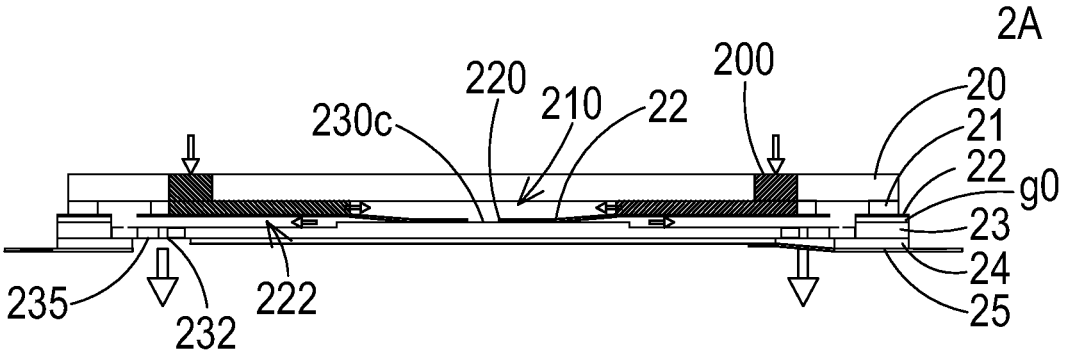

As the piezoelectric actuator 23 is actuated, the resonance of the resonance membrane 22 occurs. Consequently, the resonance membrane 22 is also vibrated along the vertical direction in the reciprocating manner. As shown in FIG. 5C, the resonance membrane 22 is vibrated downwardly and contacted with the upper portion 230*c* of the suspension plate 230 of the piezoelectric actuator 23. Due to the deformation of the resonance membrane 22, the volume of the first chamber 222 is shrunken and the middle communication space of the first chamber 222 is closed. Under this circumstance, the gas is pushed toward peripheral regions of the first chamber 222. Consequently, the gas is transferred downwardly through the vacant space 235 of the piezoelectric actuator 23.

Figure 5D:
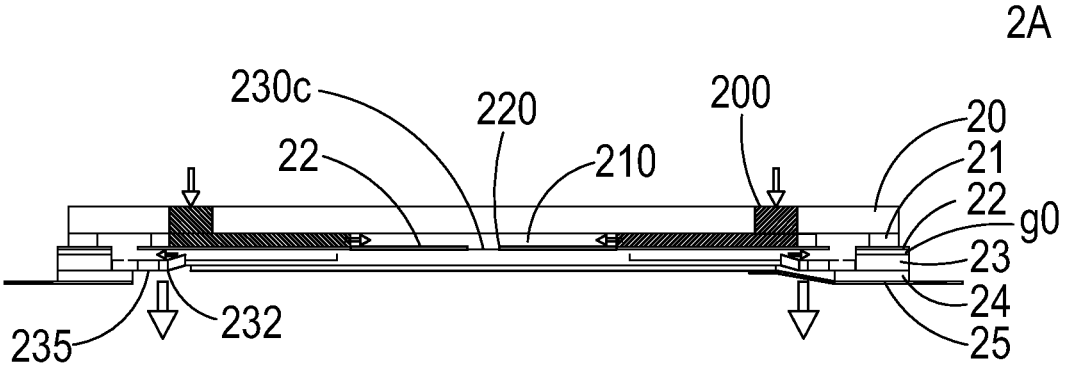

As shown in FIG. 5D, the resonance membrane 22 is returned to its original position, and the piezoelectric actuator 23 is vibrated upwardly in response to the applied voltage. Consequently, the volume of the first chamber 222 is also shrunken. Since the piezoelectric actuator 23 is ascended, the gas is continuously pushed toward peripheral regions of the first chamber 222. Meanwhile, the gas is continuously fed into the at least one inlet 200 of the gas inlet plate 20.

Figure 5E:
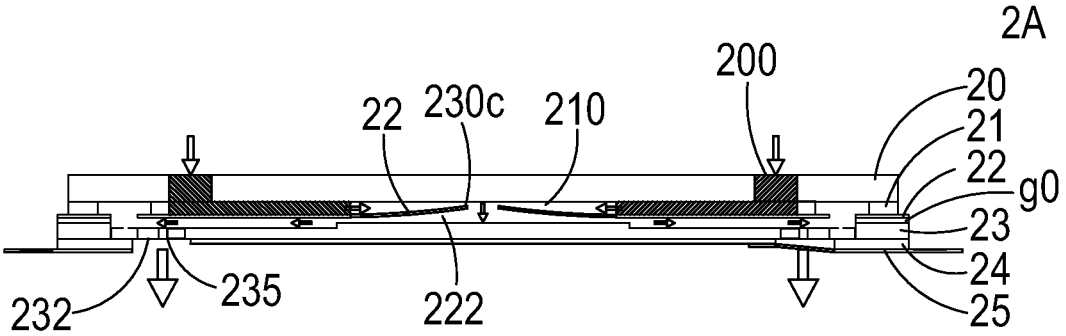

Then, as shown in FIG. 5E, the resonance of the resonance membrane 22 occurs. Consequently, the resonance membrane 22 is vibrated upwardly. Under this circumstance, the gas in the central opening 210 of the fluid channel plate 21 is transferred to the first chamber 222 through the central aperture 220 of the resonance membrane 22, then the gas is transferred downwardly through the vacant space 235 of the piezoelectric actuator 23, and finally the gas is exited from the miniature gas transportation module 2A.

From the above discussions, when the resonance membrane 22 is vibrated along the vertical direction in the reciprocating manner, the gap g0 between the resonance membrane 22 and the piezoelectric actuator 23 is helpful to increase the amplitude of the resonance membrane 22. That is, due to the gap g0 between the resonance membrane 22 and the piezoelectric actuator 23, the amplitude of the resonance membrane 22 is increased when the resonance occurs. Consequently, a pressure gradient is generated in the fluid channels of the miniature gas transportation module 2A to facilitate the gas to flow at a high speed. Moreover, since there is an impedance difference between the feeding direction and the exiting direction, the gas can be transmitted from the inlet side to the outlet side. Moreover, even if the outlet side has a gas pressure, the miniature gas transportation module 2A still has the capability of pushing out the gas.

In some embodiments, the vibration frequency of the resonance membrane 22 along the vertical direction in the reciprocating manner is identical to the vibration frequency of the piezoelectric actuator 23. That is, the resonance membrane 22 and the piezoelectric actuator 23 are synchronously vibrated along the upward direction or the downward direction. It is noted that numerous modifications and alterations of the actions of the miniature gas transportation module 2A may be made while retaining the teachings of the invention.

Figure 6A:
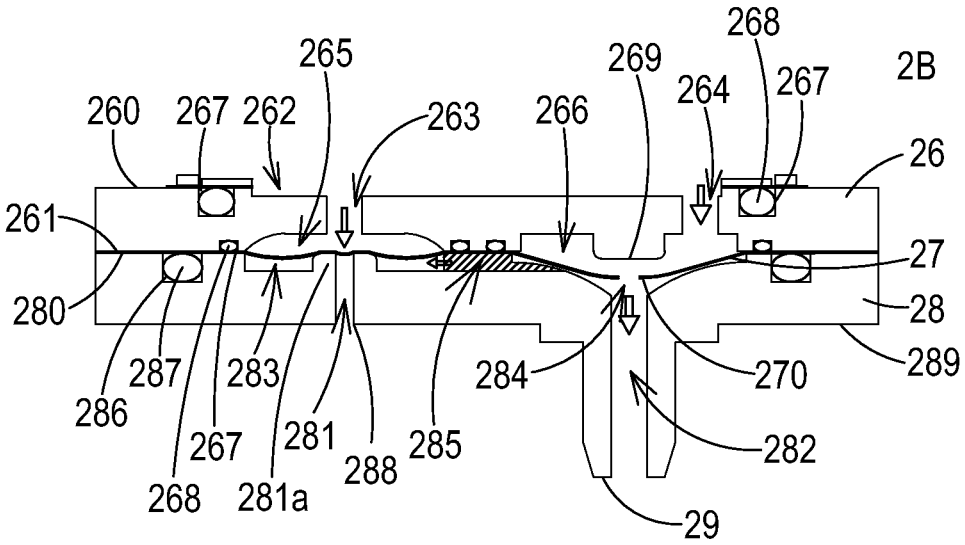
FIG. 6A schematically illustrate a gas-collecting operation of the miniature valve module of the micro-gas pressure driving apparatus of FIG. 2A.
Figure 6B:
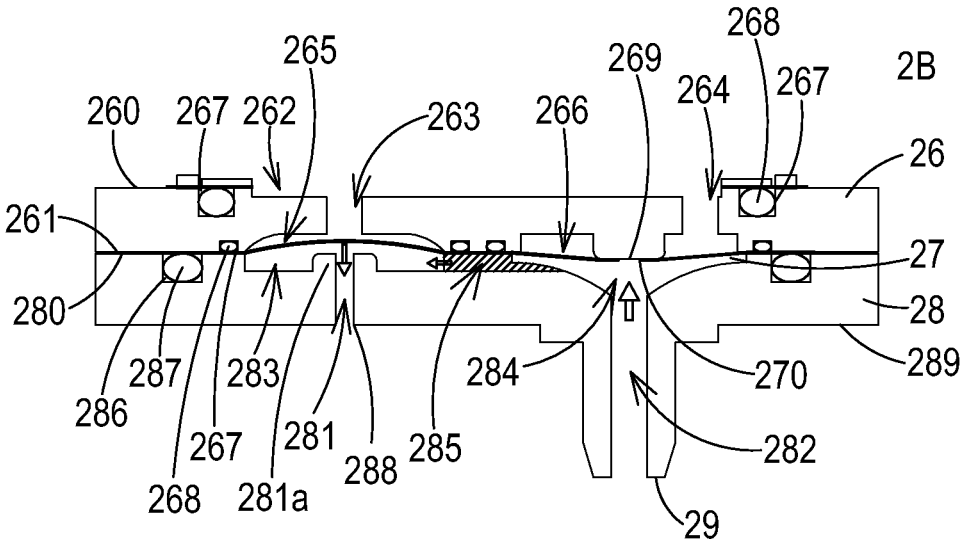
FIG. 6B schematically illustrate a gas-releasing operation of the miniature valve module of the micro-gas pressure driving apparatus of FIG. 2A.

FIG. 6A schematically illustrate a gas-collecting operation of the miniature valve module of the micro-gas pressure driving apparatus of FIG. 2A. FIG. 6B schematically illustrate a gas-releasing operation of the miniature valve module of the micro-gas pressure driving apparatus of FIG. 2A. Please refer to FIGS. 2A, 2B, 6A and 6B. As shown in FIG. 6A, the gas collecting plate 26, the valve membrane 27 and the gas outlet plate 28 of the miniature valve module 2B are stacked on each other sequentially. A first surface 260 of the gas collecting plate 26 is concaved to define a gas-collecting chamber 262. The gas that is exited downwardly from the miniature gas transportation module 2A is temporarily accumulated in the gas-collecting chamber 262. The gas collecting plate 26 comprises a first perforation 263 and a second perforation 264. A first end of the first perforation 263 and a first end of the second perforation 264 are in communication with the gas-collecting chamber 262. A second end of the first perforation 263 and a second end of the second perforation 264 are in communication with a first pressure-releasing chamber 265 and a first outlet chamber 266, which are formed in a second surface 261 of the gas collecting plate 26. Moreover, the gas collecting plate 26 has a raised structure 269 corresponding to the first outlet chamber 266. For example, the raised structure 269 includes but is not limited to a cylindrical post. The raised structure 269 is aligned with a valve opening 270 of the valve membrane 27. Moreover, the gas collecting plate 26 further comprises plural recesses 267. The plural recesses 267 are arranged around the gas-collecting chamber 262, the first pressure-releasing chamber 265 and the first outlet chamber 266 for accommodating plural sealing rings 268, respectively.

The gas outlet plate 28 comprises a third perforation 281 and a fourth perforation 282 corresponding to the first perforation 263 and the second perforation 264 of the gas collecting plate 26, respectively. A first surface 280 of the gas outlet plate 28 corresponding to the third perforation 281 is concaved to define a second pressure-releasing chamber 283. The first surface 280 of the gas outlet plate 28 corresponding to the fourth perforation 282 is concaved to define a second outlet chamber 284. The gas outlet plate 28 further comprises a communication channel 285 between the second pressure-releasing chamber 283 and the second outlet chamber 284 for allowing the gas to go through. A first end of the third perforation 281 is in communication with the second pressure-releasing chamber 283. Moreover, the gas outlet plate 28 has a raised structure 281*a* beside of the third perforation 281. For example, the raised structure 281*a* includes but is not limited to a cylindrical post. A second end of the third perforation 281 is in communication with a pressure-releasing opening 288, which is formed in a second surface 289 of the gas outlet plate 28. A first end of the fourth perforation 282 is in communication with the second outlet chamber 284. A second end of the fourth perforation 282 is in communication with an outlet 29. The outlet 29 is in communication with a container (not shown). Moreover, the gas outlet plate 28 further comprises plural recesses 286. The plural recesses 286 are arranged around the second pressure-releasing chamber 283 and the second outlet chamber 284 for accommodating plural sealing rings 287, respectively. The sealing rings 268 and 287 are made of excellent chemical-resistant rubbery material. The sealing rings 267 and 287 are accommodated within the corresponding recesses 267 and 286 for facilitating close contact between the gas collecting plate 26, the gas outlet plate 28 and the valve membrane 27 in order to prevent gas leakage.

Moreover, for assembling the valve membrane 27 with the gas collecting plate 26 and the gas outlet plate 28, the valve opening 270 of the valve membrane 27 is aligned with the raised structure 269 corresponding to the first outlet chamber 266 of the gas collecting plate 26. Due to the arrangement of the single valve opening 270, the gas is transferred through the miniature valve module 2B in one direction in response to the pressure difference.

Hereinafter, the gas-collecting operation of the miniature valve module 2B will be illustrated with reference to FIG. 6A. In case that the gas from the miniature gas transportation module 2A is transferred downwardly to the miniature valve module 2B or the ambient air pressure is higher than the inner pressure of the container which is in communication with the outlet 29, the gas will be transferred from the miniature gas transportation module 2A to the gas-collecting chamber 262 of the miniature valve module 2B. Then, the gas is transferred downwardly to the first pressure-releasing chamber 265 and the first outlet chamber 266 through the first perforation 263 and the second perforation 264. In response to the downward gas, the flexible valve membrane 27 corresponding to the first perforation 263 is bent downwardly. Consequently, the volume of the first pressure-releasing chamber 265 is expanded, and the valve membrane 27 is in close contact with the first end of the third perforation 281 corresponding to the first perforation 263. Under this circumstance, the third perforation 281 of the gas outlet plate 28 is closed, so that the gas within the second pressure-releasing chamber 283 is not leaked out from the third perforation 281. In this embodiment, the gas outlet plate 28 has the raised structure 281*a* beside of the first end of the third perforation 281. Due to the arrangement of the raised structure 281*a*, the third perforation 281 can be quickly closed by the valve membrane 27. Moreover, the raised structure 281*a* can provide a pre-force to achieve a good sealing effect. On the other hand, the gas is transferred downwardly to the first outlet chamber 266 through the second perforation 264. In response to the downward gas, the valve membrane 27 corresponding to the first outlet chamber 266 is also bent downwardly. Consequently, the valve opening 270 of the valve membrane 27 is correspondingly opened. Under this circumstance, the gas is transferred from the first outlet chamber 266 to the second outlet chamber 284 through the valve opening 270. Then, the gas is transferred to the outlet 29 through the fourth perforation 282 and then transferred to the container which is in communication with the outlet 29. Consequently, the purpose of collecting the gas pressure is achieved.

Hereinafter, the gas-releasing operation of the miniature valve module 2B will be illustrated with reference to FIG. 6B. For performing the gas-releasing operation, the user may adjust the amount of the gas to be fed into the miniature gas transportation module 2A, so that the gas is no longer transferred to the gas-collecting chamber 262. Moreover, in case that the inner pressure of the container which is in communication with the outlet 29 is higher than the ambient air pressure, the gas-releasing operation may be performed. Under this circumstance, the gas is transferred from the outlet 29 to the second outlet chamber 284 through the fourth perforation 282. Consequently, the volume of the second outlet chamber 284 is expanded, and the valve membrane 27 corresponding to the second outlet chamber 284 is bent upwardly. In addition, the valve membrane 27 is in close contact with the gas collecting plate 26. Consequently, the valve opening 270 of the valve membrane 27 is closed by the gas collecting plate 26. Moreover, the gas collecting plate 26 has a raised structure 269 corresponding to the first outlet chamber 266. Due to the arrangement of the raised structure 269, the flexible valve membrane 27 can be bent upwardly more quickly. Moreover, the raised structure 269 can provide a pre-force to achieve a good sealing effect of the valve opening 270. Since the valve opening 270 of the valve membrane 27 is closed by the raised structure 269, the gas in the second outlet chamber 284 will not be reversely returned to the first outlet chamber 266. Moreover, the gas in the second outlet chamber 284 is transferred to the second pressure-releasing chamber 283 through the communication channel 285. Consequently, the volume of the second pressure-releasing chamber 283 is expanded. Consequently, the valve membrane 27 corresponding to the second pressure-releasing chamber 283 is also bent upwardly. Since the valve membrane 27 is no longer in contact with the first end of the third perforation 281, the third perforation 281 is opened.

Under this circumstance, the gas in the second pressure-releasing chamber 283 is transferred to the third perforation 281 through the pressure-releasing opening 288. Consequently, the gas may be released. Similarly, due to the arrangement of the raised structure 281*a*, the flexible valve membrane 27 can be bent upwardly more quickly. Consequently, the third perforation 281 can be quickly opened. After the gas-releasing operation in one direction is performed, the gas within the container which is in communication with the outlet 29 is partially or completely exited to the surrounding. Under this circumstance, the pressure of the container is reduced.

Figure 7A:
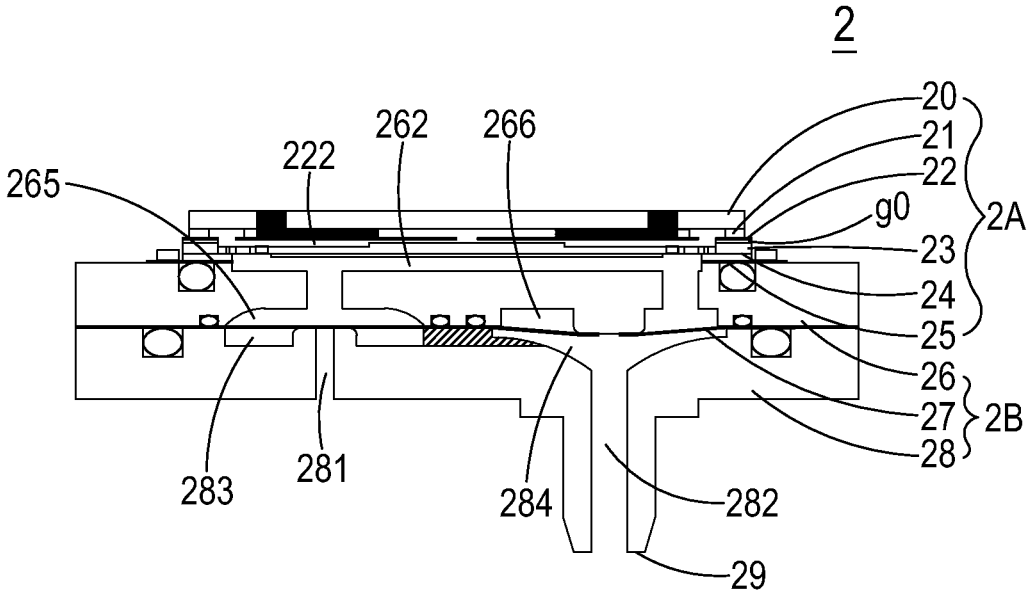
FIGS. 7A-7E schematically illustrate the gas-collecting actions of the micro-gas pressure driving apparatus of FIG. 2A.

FIGS. 7A-7E schematically illustrate the gas-collecting actions of the micro-gas pressure driving apparatus of FIG. 2A. Please refer to FIGS. 2A, 2B and 7A-7E. As shown in FIG. 7A, the micro-gas pressure driving apparatus 2 comprises the miniature gas transportation module 2A and the miniature valve module 2B. The gas inlet plate 20, the fluid channel plate 21, the resonance membrane 22, the piezoelectric actuator 23, the insulating plate 24 and the conducting plate 25 of the miniature gas transportation module 2A are stacked on each other sequentially. There is a gap g0 between the resonance membrane 22 and the piezoelectric actuator 23. Moreover, the first chamber 222 is formed between the resonance membrane 22 and the piezoelectric actuator 23. The gas collecting plate 26, the valve membrane 27 and the gas outlet plate 28 of the miniature valve module 2B are stacked on each other sequentially. The gas-collecting chamber 262 is arranged between the gas collecting plate 26 of the miniature valve module 2B and the piezoelectric actuator 23 of the miniature gas transportation module 2A. The first pressure-releasing chamber 265 and the first outlet chamber 266 are formed in the second surface 261 of the gas collecting plate 26. The second pressure-releasing chamber 283 and the second outlet chamber 284 are formed in the first surface 280 of the gas outlet plate 28. Due to the arrangements of the plural chambers, the actuation of the piezoelectric actuator 23 and the vibration of the resonance membrane 22 and the valve membrane 27, the gas can be transferred downwardly and the function of collecting the gas pressure can be achieve.

Figure 7B:
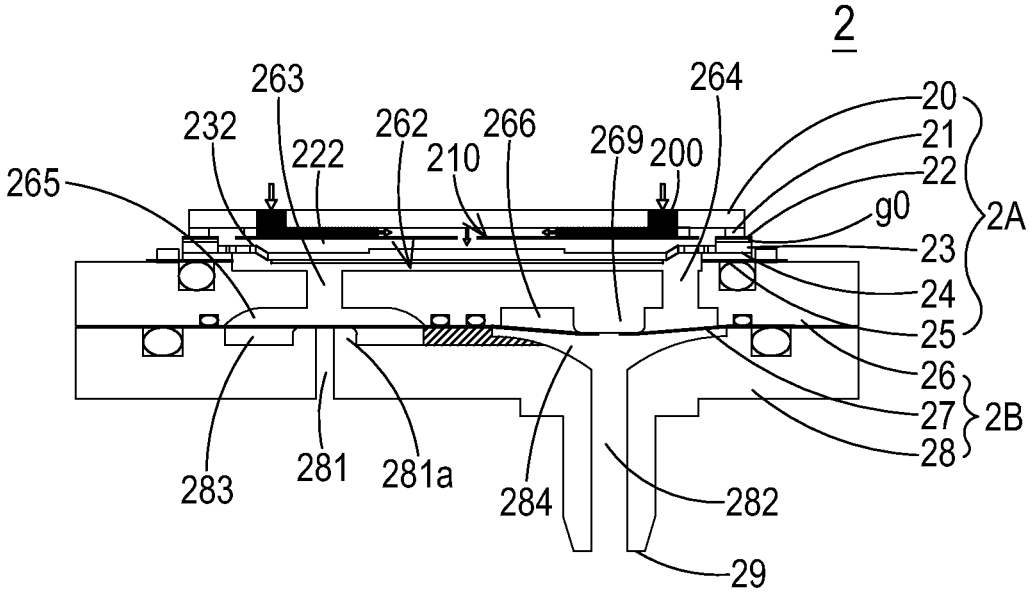

As shown in FIG. 7B, the piezoelectric actuator 23 of the miniature gas transportation module 2A is vibrated downwardly in response to the applied voltage. Consequently, the gas is fed into the miniature gas transportation module 2A through the at least one inlet 200 of the gas inlet plate 20. The gas is sequentially converged to the central opening 210 through the at least one convergence channel 211 of the fluid channel plate 21, transferred through the central aperture 220 of the resonance membrane 22, and introduced downwardly into the first chamber 222.

Figure 7C:
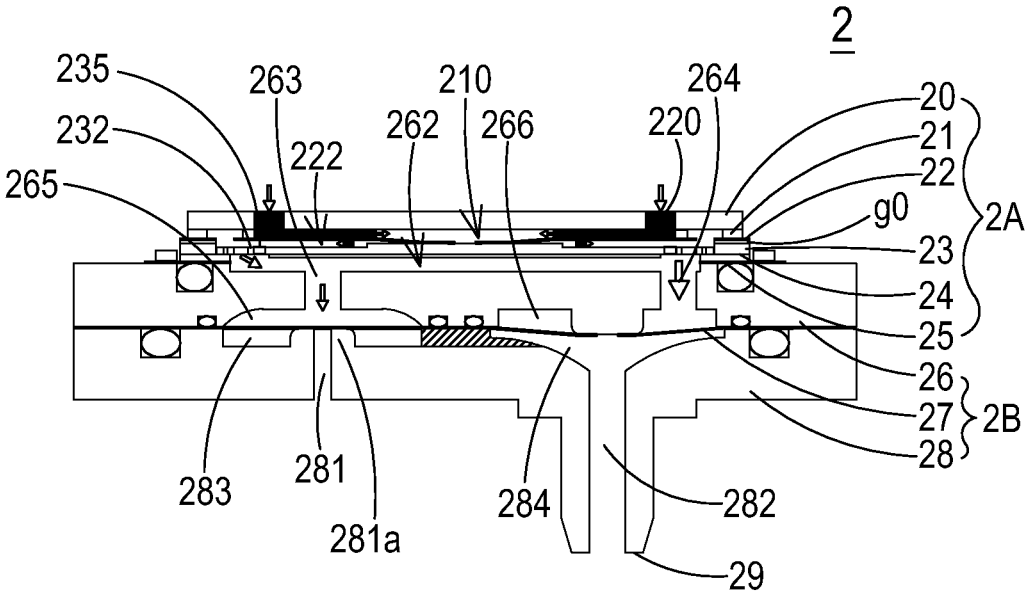

As the piezoelectric actuator 23 is actuated, the resonance of the resonance membrane 22 occurs. Consequently, the resonance membrane 22 is also vibrated along the vertical direction in the reciprocating manner. As shown in FIG. 7C, the resonance membrane 22 is vibrated downwardly and contacted with the upper portion 230*c* of the suspension plate 230 of the piezoelectric actuator 23. Due to the deformation of the resonance membrane 22, the volume of the chamber corresponding to the central opening 210 of the fluid channel plate 21 is expanded but the volume of the first chamber 222 is shrunken. Under this circumstance, the gas is pushed toward peripheral regions of the first chamber 222. Consequently, the gas is transferred downwardly through the vacant space 235 of the piezoelectric actuator 23. Then, the gas is transferred to the gas-collecting chamber 262 between the miniature gas transportation module 2A and the miniature valve module 2B. Then, the gas is transferred downwardly to the first pressure-releasing chamber 265 and the first outlet chamber 266 through the first perforation 263 and the second perforation 264, which are in communication with the gas-collecting chamber 262.

Figure 7D:
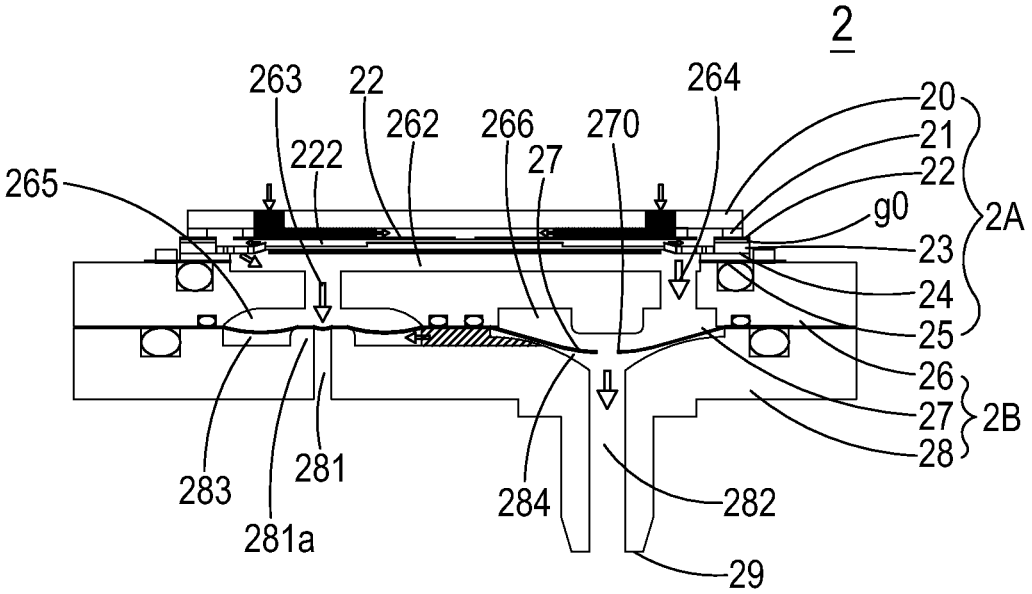

As shown in FIG. 7D, the resonance membrane 22 of the miniature gas transportation module 2A is returned to its original position, and the piezoelectric actuator 23 is vibrated upwardly in response to the applied voltage. Consequently, the volume of the first chamber 222 is also shrunken, and the gas is continuously pushed toward peripheral regions of the first chamber 222. Moreover, the gas is continuously transferred to the gas-collecting chamber 262, the first pressure-releasing chamber 265 and the first outlet chamber 266 of the miniature valve module 2B through the vacant space 235 of the piezoelectric actuator 23. Consequently, the pressure in the first pressure-releasing chamber 265 and the first outlet chamber 266 will be gradually increased. In response to the increased gas pressure, the flexible valve membrane 27 is bent downwardly. Consequently, the valve membrane 27 corresponding to the second pressure-releasing chamber 283 is moved downwardly and contacted with the raised structure 281*a* corresponding to the first end of the third perforation 281. Under this circumstance, the third perforation 281 of the gas outlet plate 28 is closed. In the second outlet chamber 284, the valve opening 270 of the valve membrane 27 corresponding to the fourth perforation 282 is closed. Then, the gas within the second outlet chamber 284 is transferred downwardly to the outlet 29 through the fourth perforation 282 and then transferred to the container which is in communication with the outlet 29. Consequently, the purpose of collecting the gas pressure is achieved.

Figure 7E:
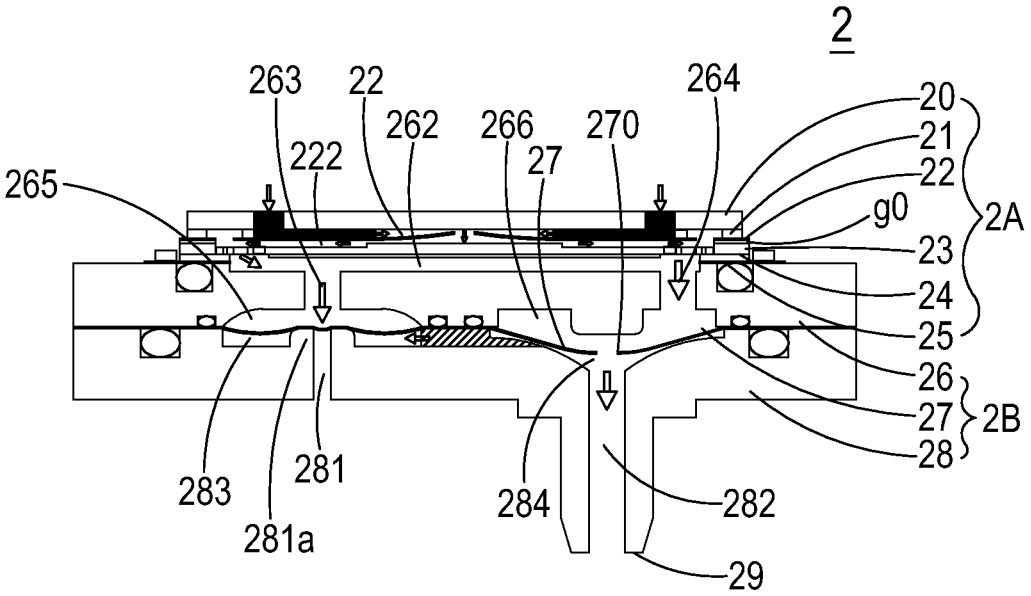

Then, as shown in FIG. 7E, the resonance membrane 22 of the miniature gas transportation module 2A is vibrated upwardly. Under this circumstance, the gas in the central opening 210 of the fluid channel plate 21 is transferred to the first chamber 222 through the central aperture 220 of the resonance membrane 22, and then the gas is transferred downwardly to the miniature valve module 2B through the vacant space 235 of the piezoelectric actuator 23. As the gas pressure is continuously increased along the downward direction, the gas is continuously transferred to the gas-collecting chamber 262, the second perforation 264, the first outlet chamber 266, the second outlet chamber 284 and the fourth perforation 282 of the miniature valve module 2B and then transferred to the container which is in communication with the outlet 29. In other words, the pressure-collecting operation is triggered by the pressure difference between the ambient pressure and the inner pressure of the container.

Figure 8:
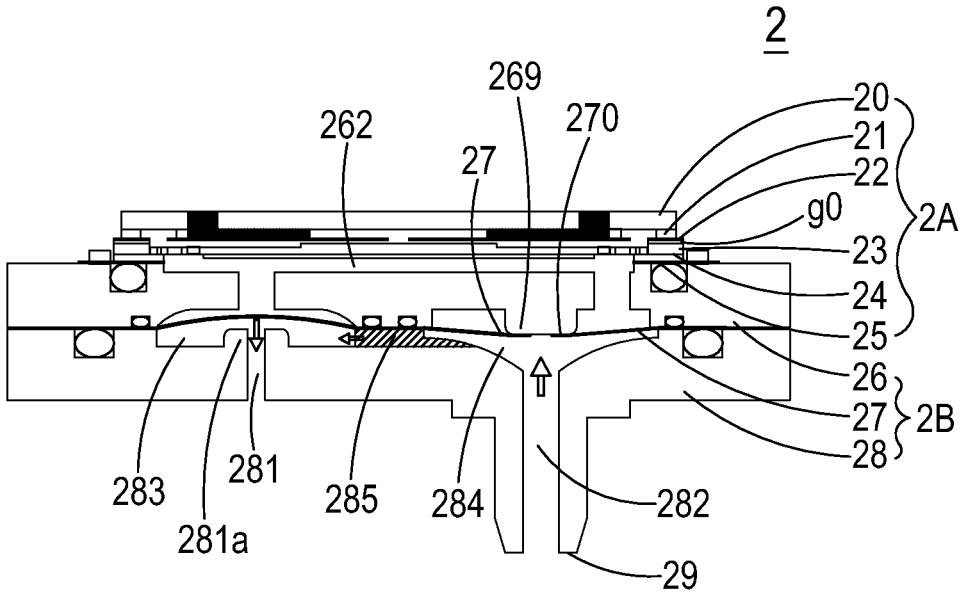
FIG. 8 schematically illustrate the gas-releasing actions or the pressure-reducing actions of the micro-gas pressure driving apparatus of FIG. 2A.

FIG. 8 schematically illustrate the gas-releasing actions or the pressure-reducing actions of the micro-gas pressure driving apparatus of FIG. 2A. In case that the inner pressure of the container which is in communication with the outlet 29 is higher than the ambient air pressure, the gas-releasing operation (or a pressure-reducing operation) may be performed. As mentioned above, the user may adjust the amount of the gas to be fed into the miniature gas transportation module 2A, so that the gas is no longer transferred to the gas-collecting chamber 262. Under this circumstance, the gas is transferred from the outlet 29 to the second outlet chamber 284 through the fourth perforation 282. Consequently, the volume of the second outlet chamber 284 is expanded, and the valve membrane 27 corresponding to the second outlet chamber 284 is bent upwardly. In addition, the valve membrane 27 is in close contact with the raised structure 269 corresponding to the first outlet chamber 266.

Since the valve opening 270 of the valve membrane 27 is closed by the raised structure 269, the gas in the second outlet chamber 284 will not be reversely returned to the first outlet chamber 266. Moreover, the gas in the second outlet chamber 284 is transferred to the second pressure-releasing chamber 283 through the communication channel 285, and then the gas in the second pressure-releasing chamber 283 is transferred to the third perforation 281 through the pressure-releasing opening 288. Under this circumstance, the gas-releasing operation is performed. After the gas-releasing operation of the miniature valve module 2B in one direction is performed, the gas within the container which is in communication with the outlet 29 is partially or completely exited to the surrounding. Under this circumstance, the pressure of the container is reduced.

From the above descriptions, the present invention provides the micro-gas pressure driving apparatus. The micro-gas pressure driving apparatus comprises the miniature gas transportation module and the miniature valve module. After the gas is fed into the miniature gas transportation module through the inlet, the piezoelectric actuator is actuated. Consequently, a pressure gradient is generated in the fluid channels of the miniature gas transportation module and the gas-collecting chamber to facilitate the gas to flow to the miniature valve module at a high speed. Moreover, due to the one-way valve membrane of the miniature valve module, the gas is transferred in one direction. Consequently, the pressure of the gas is accumulated to any container that is connected with the outlet. For performing a gas-releasing operation (or a pressure-reducing operation), the user may adjust the amount of the gas to be fed into the miniature gas transportation module, so that the gas is no longer transferred to the gas-collecting chamber. Under this circumstance, the gas is transferred from the outlet to the second outlet chamber of the miniature valve module, then transferred to the second pressure-releasing chamber through the communication channel, and finally exited from the pressure-releasing opening. By the micro-gas pressure driving apparatus of the present invention, the gas can be quickly transferred while achieving silent efficacy. Moreover, due to the special configurations, the micro-gas pressure driving apparatus of the present invention has small volume and small thickness. Consequently, the micro-gas pressure driving apparatus is portable and applied to medical equipment or any other appropriate equipment. In other words, the micro-gas pressure driving apparatus of the present invention has industrial values.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A micro-gas pressure driving apparatus, comprising:

a miniature gas transportation module comprising:

a gas inlet plate having at least one inlet, wherein a gas is fed into the miniature gas transportation module through the at least one inlet;

a fluid channel plate comprising at least one convergence channel and a central opening, wherein the at least one convergence channel is aligned with the at least one inlet of the gas inlet plate, wherein after the gas is fed into the at least one inlet, the gas is guided by the at least one convergence channel and converged to the central opening;

a resonance membrane having a central aperture corresponding to the central opening of the fluid channel plate; and a piezoelectric actuator comprising a suspension plate, an outer frame and a piezoelectric ceramic plate, wherein the suspension plate and the outer frame are connected with each other through at least one bracket, and the piezoelectric ceramic plate is attached on a surface of the suspension plate, wherein the gas inlet plate, the fluid channel plate, the resonance membrane and the piezoelectric actuator are stacked on each other sequentially, and the resonance membrane and the piezoelectric actuator are separated from each other by a gap, so that a first chamber is defined between the resonance membrane and the piezoelectric actuator, wherein when the piezoelectric actuator is activated to feed the gas into the miniature gas transportation module through the at least one inlet, sequentially converge the gas through the at least one convergence channel to the central opening of the fluid channel plate, transferred through the central aperture of the resonance membrane, introduced into the first chamber, transferred downwardly through a vacant space between the at least one bracket, the suspension plate and the outer frame, and exited from the miniature gas transportation module; and a miniature valve module comprising:

a gas collecting plate comprising a first perforation, a second perforation, a first pressure-releasing chamber and a first outlet chamber, wherein the first perforation is in communication with the first pressure-releasing chamber, and the second perforation is in communication with the first outlet chamber;

a valve membrane having a valve opening; and a gas outlet plate comprising a third perforation corresponding to the first perforation of the gas collecting plate, a fourth perforation corresponding to the second perforation of the gas collecting plate, a second pressure-releasing chamber, a second outlet chamber and a communication channel, wherein the third perforation is in communication with the second pressure-releasing chamber, the fourth perforation is in communication with the second outlet chamber, and the communication channel is arranged between the second pressure-releasing chamber and the second outlet chamber, wherein the gas collecting plate, the valve membrane and the gas outlet plate are stacked on each other sequentially, the valve membrane is arranged between the gas collecting plate and the gas outlet plate, and the valve opening of the valve membrane is arranged between the second perforation and the fourth perforation, wherein after the gas is downwardly transferred from the miniature gas transportation module to the miniature valve module, the gas is introduced into the first pressure-releasing chamber and the first outlet chamber through the first perforation and the second perforation, and the gas within the first outlet chamber is further transferred to the fourth perforation through the valve opening of the valve membrane, so that a pressure of the gas is collected, wherein if the collected pressure of the gas is higher than an ambient pressure and a pressure-releasing operation is performed, the gas is transferred from the fourth perforation to the second outlet chamber to move the valve membrane such that the valve opening of the valve membrane is contacted with and closed by the gas collecting plate, the gas is transferred from the second outlet chamber to the second pressure-releasing chamber through the communication channel, and the gas is exited from the third perforation.

2. The micro-gas pressure driving apparatus according to claim 1, wherein the miniature gas transportation module further comprises an insulating plate and a conducting plate, wherein the insulating plate and the conducting plate are sequentially disposed under the piezoelectric actuator.

3. The micro-gas pressure driving apparatus according to claim 1, wherein the fluid channel plate and the gas inlet plate of the miniature gas transportation module are integrally formed with each other.

4. The micro-gas pressure driving apparatus according to claim 1, wherein the suspension plate of the piezoelectric actuator is a stepped structure including a lower portion and an upper portion, wherein a top surface of the upper portion is coplanar with a top surface of the outer frame, wherein the upper portion of the suspension plate or the top surface of the outer frame has a specified height with respect to the lower portion of the suspension plate or the top surface of the at least one bracket.

5. The micro-gas pressure driving apparatus according to claim 1, wherein the surface of the suspension plate is a bottom surface of the suspension plate, a bottom surface of the outer frame and a bottom surface of the at least one bracket are coplanar with each other.

6. The micro-gas pressure driving apparatus according to claim 1, wherein the miniature valve module further comprises a gas-collecting chamber, which is formed in a first surface of the gas collecting plate, wherein the gas-collecting chamber is in communication with the first perforation and the second perforation.

7. The micro-gas pressure driving apparatus according to claim 6, wherein the first pressure-releasing chamber and the first outlet chamber of the miniature valve module are formed in a second surface of the gas collecting plate, wherein the second surface of the gas collecting plate is opposed to the first surface of the gas collecting plate.

8. The micro-gas pressure driving apparatus according to claim 1, wherein the gas collecting plate of the miniature valve module further comprises a raised structure corresponding to the first outlet chamber, wherein the raised structure is aligned with the valve opening of the valve membrane for providing a pre-force to tightly close the valve opening.

9. The micro-gas pressure driving apparatus according to claim 1, wherein the second pressure-releasing chamber and the second outlet chamber of the miniature valve module are formed in a surface of the gas outlet plate, wherein the second pressure-releasing chamber and the second outlet chamber are aligned with the first pressure-releasing chamber and the first outlet chamber of the gas collecting plate, respectively.

10. The micro-gas pressure driving apparatus according to claim 1, wherein the gas outlet plate of the miniature valve module further comprises a raised structure corresponding to an end of the third perforation, wherein the raised structure provides a pre-force to tightly close the third perforation, or the raised structure facilitates quickly opening the third perforation.

11. A micro-gas pressure driving apparatus, comprising:

a miniature gas transportation module comprising a gas inlet plate, a fluid channel plate, a resonance membrane and a piezoelectric actuator, wherein the gas inlet plate, the fluid channel plate, the resonance membrane and the piezoelectric actuator are stacked on each other sequentially, and the resonance membrane and the piezoelectric actuator are separated from each other by a gap, so that a first chamber is defined between the resonance membrane and the piezoelectric actuator, wherein when the piezoelectric actuator is activated to feed a gas into the miniature gas transportation module, the gas is transferred to the first chamber through the fluid channel plate and the resonance membrane and then transferred downwardly; and a miniature valve module comprising a gas collecting plate, a valve membrane and a gas outlet plate, wherein the gas collecting plate comprises a first pressure-releasing chamber, a first outlet chamber and at least a first perforation and a second perforation, the valve membrane has a valve opening, and the gas outlet plate comprises a second pressure releasing chamber, a second outlet chamber, a communication channel and at least a third and a fourth perforation, wherein the gas collecting plate, the valve membrane and the gas outlet plate are stacked on each other sequentially, a gas-collecting chamber is formed between the miniature gas transportation module and the miniature valve module, wherein the first perforation is in communication with the first pressure-releasing chamber, the second perforation is in communication with the first outlet chamber and the communication channel is arranged between the second pressure-releasing chamber and the second outlet chamber, wherein after the gas is downwardly transferred from the miniature gas transportation module to the gas-collecting chamber, the gas is introduced into the miniature valve module, wherein while the gas is transferred through at least the first perforation and the second perforation and the first pressure-releasing chamber and the first outlet chamber of the gas collecting plate and the third perforation, the fourth perforation, the second pressure-releasing chamber and the second outlet chamber of the gas outlet plate in one direction, the valve opening of the valve membrane is correspondingly opened or closed, so that a pressure-collecting operation or a pressure-releasing operation is performed.

12. The micro-gas pressure driving apparatus according to claim 11, wherein the gas inlet plate has at least one inlet and the gas is fed into the miniature gas transportation module through the at least one inlet, wherein the fluid channel plate comprises at least one convergence channel corresponding to the at least one inlet of the gas inlet plate and a central opening, and the gas is guided by the at least one convergence channel and converged to the central opening, wherein the resonance membrane has a central aperture corresponding to the central opening of the fluid channel plate, wherein the piezoelectric actuator comprises a suspension plate, an outer frame and a piezoelectric ceramic plate, wherein the suspension plate and the outer frame are connected with each other through at least one bracket, and the piezoelectric ceramic plate is attached on a surface of the suspension plate.

13. The micro-gas pressure driving apparatus according to claim 11, wherein the valve membrane is arranged between the gas collecting plate and the gas outlet plate, and the valve opening of the valve membrane is arranged between the second perforation and the fourth perforation, wherein after the gas is downwardly transferred from the miniature gas transportation module to the miniature valve module, the gas is introduced into the first pressure-releasing chamber and the first outlet chamber through the first perforation and the second perforation, and the gas within the first outlet chamber is further transferred to the fourth perforation through the valve opening of the valve membrane, so that a pressure of the gas is collected, wherein if the collected pressure of the gas is higher than an ambient pressure and the pressure-releasing operation is performed, the gas is transferred from the fourth perforation to the second outlet chamber to move the valve membrane, the valve opening of the valve membrane is contacted with and closed by the gas collecting plate, the gas is transferred from the second outlet chamber to the second pressure-releasing chamber through the communication channel, and the gas is exited from the third perforation.

* * * * *